United States Patent [19]

Schweingruber

[11] 4,367,997

[45] Jan. 11, 1983

[54] DEVICE FOR CREATING BATCHES OF FLAT WORKPIECES SUCH AS BOX BLANKS

[75] Inventor: Hermann Schweingruber, Sullens, Switzerland

[73] Assignee: Bobst SA, Lausanne, Switzerland

[21] Appl. No.: 193,022

[22] Filed: Oct. 2, 1980

[30] Foreign Application Priority Data

Oct. 9, 1979 [CH] Switzerland ..... 9072/79

[51] Int. Cl.[3] ..... B65H 31/30

[52] U.S. Cl. ..... 414/38; 198/408; 198/462; 271/182; 271/184; 271/302; 414/28; 414/46; 414/91; 414/108

[58] Field of Search ..... 414/28, 38, 46, 52, 414/91, 104, 108; 271/182, 183, 184, 202, 302; 198/408, 462

[56] References Cited

U.S. PATENT DOCUMENTS

| | | | |
|---|---|---|---|
| 2,478,610 | 8/1949 | Uschmann et al. | 271/302 X |
| 3,580,402 | 5/1971 | Tolf et al. | 414/46 X |
| 3,717,075 | 2/1973 | Lopez | 414/91 X |
| 4,141,193 | 2/1979 | Joa | 198/408 X |
| 4,203,694 | 5/1980 | James | 414/28 |

*Primary Examiner*—Leslie J. Paperner

*Attorney, Agent, or Firm*—Hill, Van Santen, Steadman, Chiara & Simpson

[57] ABSTRACT

A device for piling up flat workpieces especially box blanks characterized by a conveyor for transporting the box blanks in at least one stream of staggered blanks, a device for braking and separating the blanks in each stream of box blanks, a device for removing box blanks having contingent flaws from the conveyor, a piling device for forming piles of box blanks from the stream of blanks in the conveyor, a removing device for removing the piles of box blanks created in the piling device, a device for creating batches of box blanks standing on their edges from the piles and a device for transferring the piles of box blanks in an aligned fashion to the device for creating the batches. In particular the device for conveying includes a plurality of conveyors aligned one after the other in the direction of transport with the last conveyor in the direction of transport being pivotable around the drive roller and being part of the device for rejecting box blanks having contingent flaws. The drive for braking and separating includes a lower roll mounted between a pair of the conveyors coacting with the upper pressure roller which is moved into engagement to squeeze a box therebetween.

9 Claims, 15 Drawing Figures

FIG. 3
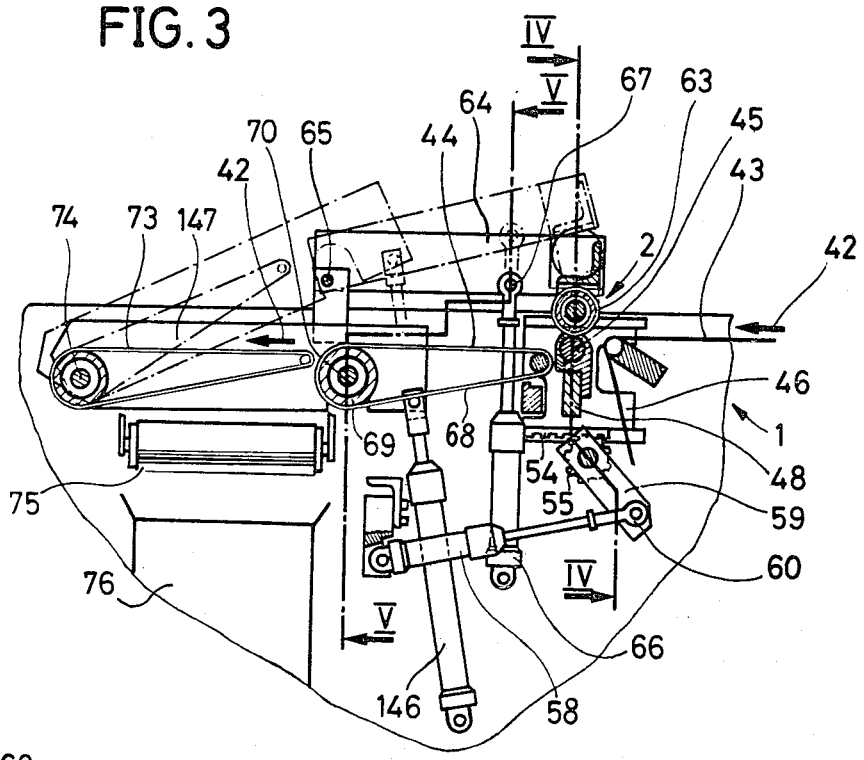
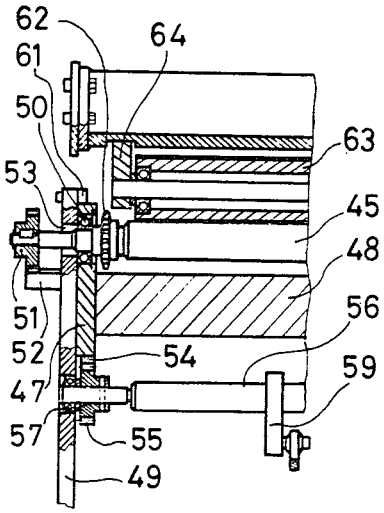
FIG. 4
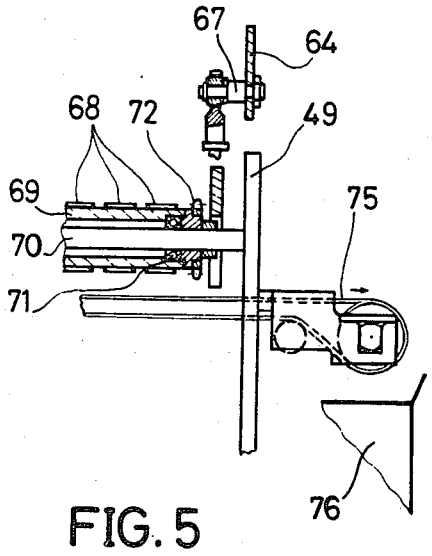
FIG. 5

A
B
142
37
8
7
143
152
149
151
41
150
156
40
148
154
153
90
155
6
39
4
140
36
145
29
34
33
38
144
141

DEVICE FOR CREATING BATCHES OF FLAT WORKPIECES SUCH AS BOX BLANKS

BACKGROUND OF THE INVENTION

The present invention is concerned with a device for piling up flat workpieces such as box blanks and creating batches of box blanks standing on their edges from the piles of box blanks.

Box blanks are cut and creased for instance by a printing and die cutting machine and are generally delivered in the form of separate piles within the delivery station of the machine. This operation can be carried out either manually or automatically in event of high production speed. If the box blanks are delivered manually, the user will first of all be compelled to collect a certain number of blanks in the stream traveling from the machine with the number of the blanks in a particular batch being identified by a laterally displaced or shifted blank in the stream of blanks. Thereafter, the user will set up the pile by an operation which includes knocking the edges of the pile along one side of the pile as well as along the adjacent side on a table to make sure that the pile is reliably straight and aligned.

If the box blanks are delivered automatically, the delivering device consists of a compartments which have a front stop and side guide. Since the box blanks leave the delivery station in the form of up to eleven individual streams which depend on the particular run and which streams are arranged over the whole width of the delivery station, it is necessary to invision a considerable number of side guides to insure proper guidance of each of the streams of boxes. The sides of the blanks as well as the side-wise position of each stream is variable and all the lateral guides must be constructed to be positioned with regard to one another. Obviously, the construction of such delivery station and its adjustment for a particular batch of the blank is carried out with great accuracy and involves a lengthy set up operation. In addition, the setting up of the delivery station of the device depends on the side-wise position of every blank stream arriving at the delivery station. Such a dependence is a handicap, for in the course of a run, the user often happens to be compelled to somewhat modify the interval existing between the various streams at the beginning of their shaping and at the station before the delivery station. In such a case all the settings carried out previously should be recorded and corrected and this correction will entail a necessity of stopping the machine.

SUMMARY OF THE INVENTION

The present invention is directed to offering an answer to the problems of supplying the user with a device which will enable creating the piles, collecting the piles and then moving the collected piles to a device for creating batches of the piles.

To accomplish these goals, the device for creating batches of flat workpieces comprises conveyor means for transporting the box blanks in at least one stream of staggered blanks in a transport direction, said conveyor means enabling adequate staggering of the box blanks in each stream; means for braking and separating the blanks in each stream of box blanks; means for removing the box blanks having contingent flaws from the conveyor means; piling means for forming piles of box blanks from the stream of the blanks in the conveyor means; removing means for removing the pile of box blanks created in the piling means; means for creating batches of box blanks from the piles; and means for transferring the piles of box blanks in an aligned fashion from the means for removing to said means for creating batches. In particular, the conveyor means includes several conveyors assembled one after the other in a transport direction in a frame, said means for removing box blanks for contingent flaws including the last conveyor of the conveyor means in the transport direction being constructed to be pivoted around a drive roller for the conveyor from a conveying position to a reject position and a reject receiving belt extending cross-wise to the transport direction being arranged adjacent said last conveyor to receive blanks as the conveyor is pivoted to the reject position.

The means for braking and separating comprises a lower roll arranged between a pair of conveyors in the conveying means, said lower roll being carried on a cradle mounted in said frame for movement along said transport direction, an upper pressure roll, means for moving the upper pressure from a position above the lower roll to a position pressing a blank therebetween, means for rotating the lower roll in one direction including a clutch, second means for rotating the lower roll in a direction opposite to the one direction of rotation, said second means being actuated by movement of the cradle in said frame in a direction opposite to the transport direction so that during a braking operation, the clutch is disengaged and the cradle is moved in said opposite direction to rotate the lower roll in the direction opposite to the one direction.

The piling means includes a front stop being mounted for adjustment in both a vertical direction and the transport direction and means for determining the height of the blanks in the pile means. Preferably, the piling means includes a platform, which is movable in a vertical direction so that as the pile is created thereon, the level of the platform is located below the level of the conveying means.

The means for removing the piles of blanks from the piling means includes a removable belt and a pusher for pushing the piles from the piling means onto the removable belt. The pusher means is actuated in response to the means for determining a predetermined height of the pile and the removable belt preferably extends and transfers the piles in a direction transverse to the direction of movement of the pusher.

The means for transferring the piles from the means for removing the piles to the means creating batches aligns each of the piles and includes means for rotating the piles through at least 90° in the plane of the blank, and means for rotating the pile to stand on the edges of the blanks. The means for rotating the piles through at least 90° includes an endless chain with catches, which engage the edge of the pile on the removable belt and coact with a retractable stop to shift or rotate the pile on the belt.

The means for creating batches includes a conveyor chain for moving the piles while standing on edges and joggers or pushers for shifting the piles into the delivery station as a batch of box blanks standing on edge. Preferably each of the delivery stations includes a pair of brushes for engaging the edges of each of the batches as they are pushed onto the delivery station.

The advantages obtained by the use of such a device are based on the very short set up time as well as in the fact that the setting up is not influenced by the sideways arrival position of the stream of folded blanks in the device.

BRIEF DESCRIPTION OF THE DRAWINGS

FIG. 3 is a cross-sectional view with portions in elevation for purposes of illustration at the end of the conveying belt and the blank rejection station of the device of the present invention;

FIG. 4 is a partial cross-sectional view taken along the lines IV—IV of FIG. 3;

FIG. 5 is a partial cross-sectional view taken along the lines V—V of FIG. 3;

DESCRIPTION OF THE PREFERRED EMBODIMENTS

Figure 1:
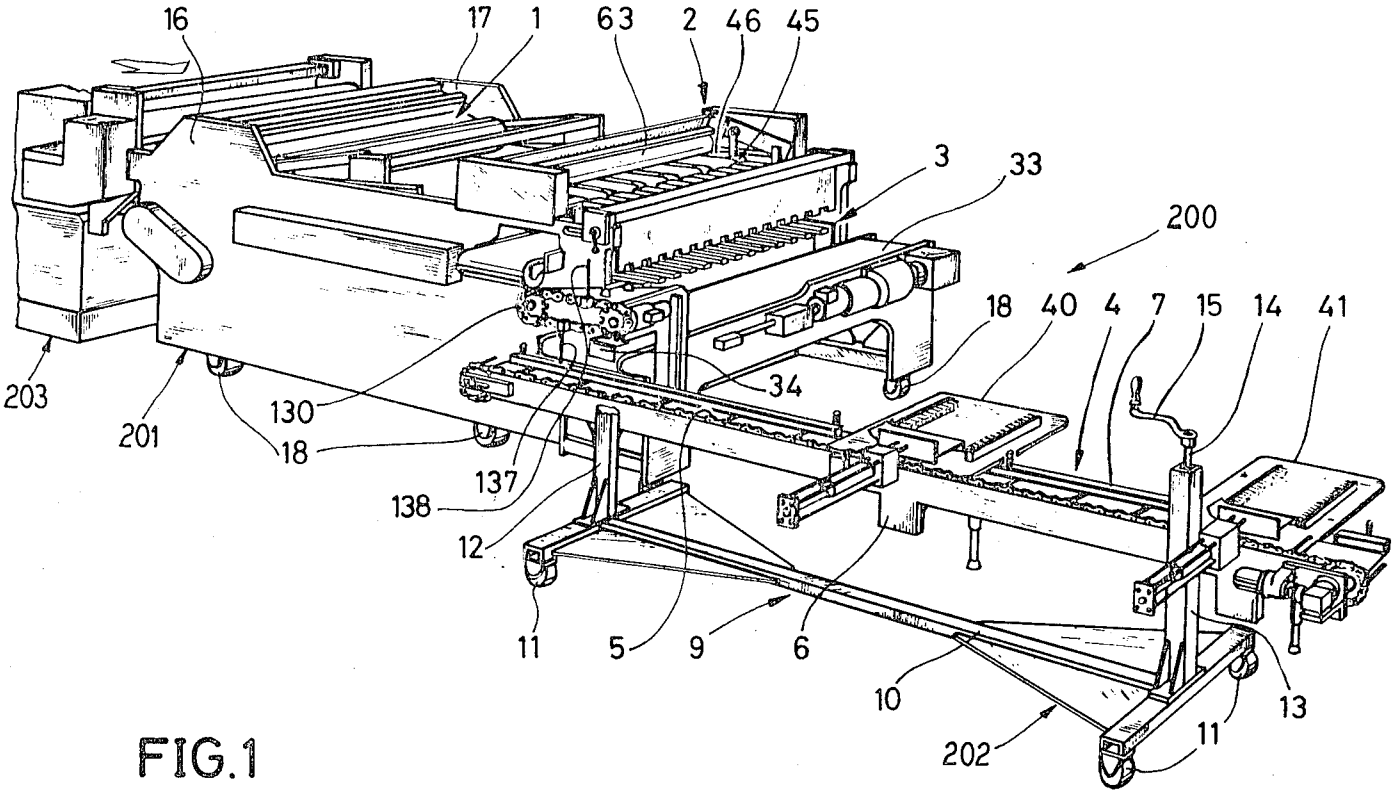
FIG. 1 is a general perspective view of the device of the present invention.

The principles of the present invention are particularly useful in a device for forming batches of flat workpieces such as box blanks which is generally indicated at 200 in FIG. 1. The batch forming device 200 is composed of a pair of units 201 and 202 with the first unit 201 having conveyor means generally indicated at 1, means for braking the flow of blanks in the conveyor means 1 generally indicated at 2 and a blank pile forming mechanism including a pile means and means for removing piles generally indicated at 3. The second unit 202 includes means for forming batches of blanks generally indicated at 4. The device 200 is provided at the outlet or delivery of the machine generally indicated at 203 which machine may be a printing and die cutting machine which discharges blanks in at least one stream or flow of staggered blanks.

Figures 13, 14, 15:
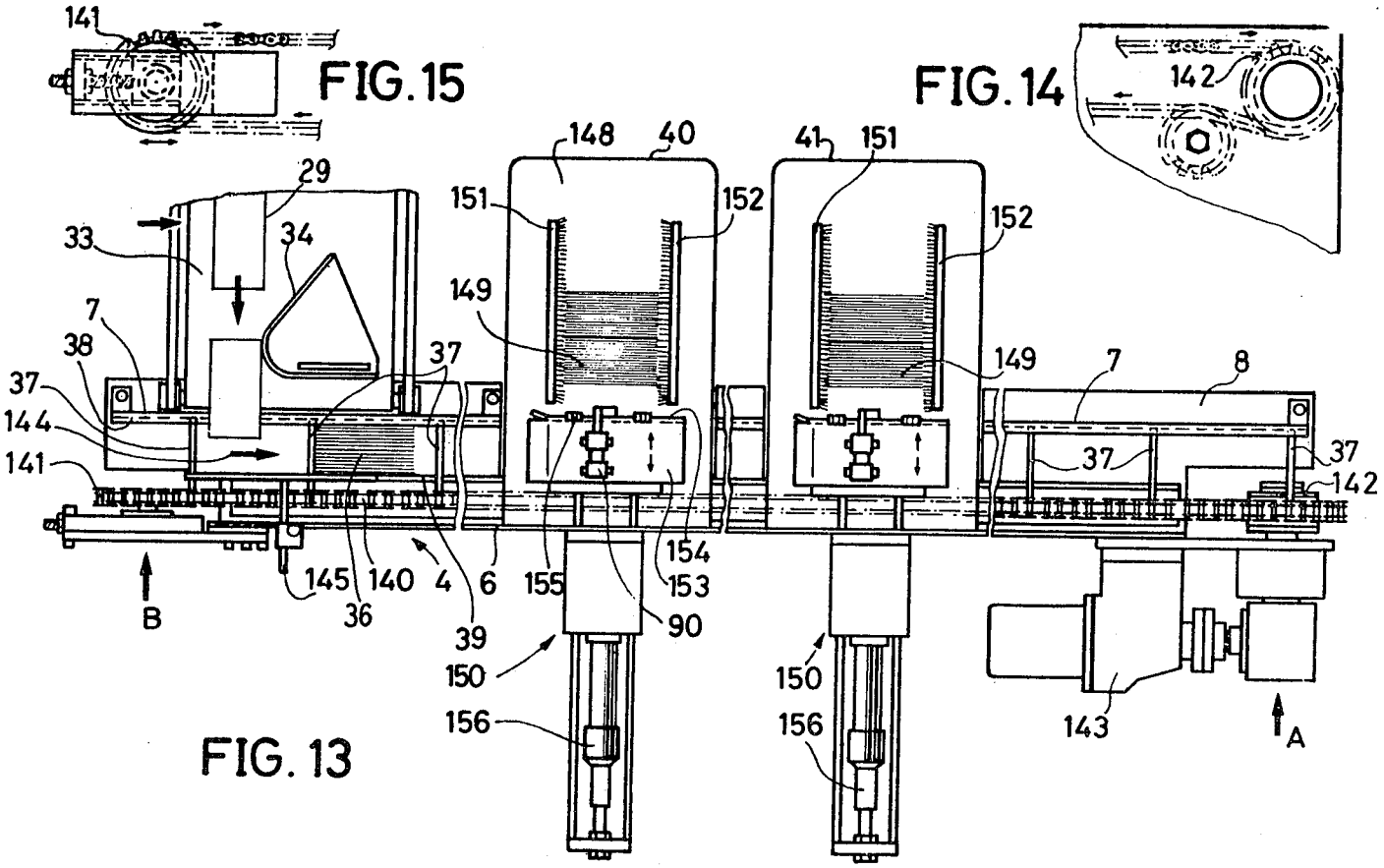
FIG. 13 is a partial plan view illustrating a transfer mechanism and batching mechanism of the present invention.
FIG. 14 is a partial side view taken from the direction of arrow A of FIG. 13.
FIG. 15 is a partial side view taken in the direction of arrow B of FIG. 13.

The batching mechanism or station 4, which handles the piles of box blanks, consists of a chain conveyor 5 which is supported between two frame members 6 and 7 which are connected by a base plate 8 as illustrated in FIG. 13. The frame member 6 and 7 (FIG. 1) are supported by a chassis 9 which consists of a base 10. The base 10 is mounted on casters 11 which can be interlocked by a conventional brake, which is not illustrated, as soon as the pile batching mechanism of the unit 202 is properly positioned with regard to the other machine stations of unit 201 of the device 200. The base 10 is also equipped with two columns 12 and 13 within which are provided with a height adjusting system which comprises screws and nuts to insure a proper height and level of the mechanism 4 relative to the other stations. The nuts of the system, which are not represented, are secured to the frame 6 and the screws 14 are mounted on bearings provided on each of the columns 12 and 13. The adjusting of the height is achieved by turning a crank 15 connected the screw 14 wither clockwise or counter-clockwise depending on whether the frame members 6 and 7 along the conveyor chain 5 are to be raised or lowered relative to the other unit 201.

The unit 201, which has the conveying station 1, the braking station 2, and the piling and removal station 3, includes a frame having lateral frame portions 16 and 17 which are connected one to another by means of cross bars which are not illustrated. The frame of the unit 201 on the lower surface are provided with casters or wheels 18 with conventional braking devices so that the entire mechanism or unit as well as the batching mechanism 4 can be positioned relative to the delivery station of the machine 203 which produces the box blanks. The units 201 and 202 will each have independent motors for driving the various rolls, conveyors and belts.

Figure 2:
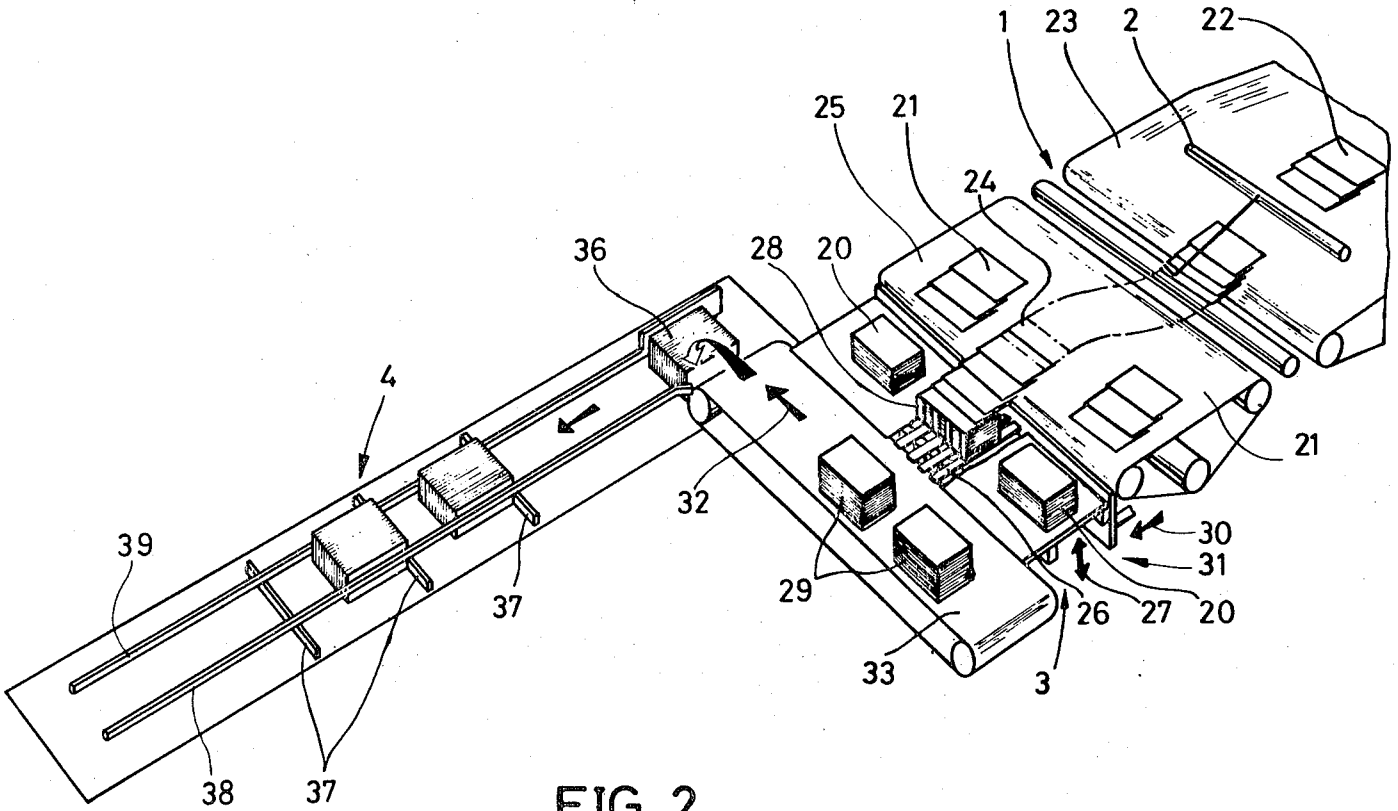
FIG. 2 is a schematic perspective view diagrammatically illustrating the various operations being performed by the device of the present invention.

As best illustrated in FIG. 2, the conveyor mechanism or means 1 delivers streams such as 22 of individual box blanks 21 which are stacked in piles 20. For purposes of simplification, only one single stream 22 is completely illustrated on the conveyor 23 and this stream is slowed by a braking means 2, which is schematically illustrated so that a portion 24 will be carried by a conveyor 25 as far as the piling station 3, in which the piles 20 are formed. The blanks 21 are piled up on a movable table or platform 26, which can be shifted in a vertical direction indicated by a double arrow 27. When its blanks 21 are being placed in the piles 20, they have a front surface knocked against a front stop 28. During the time which is required to finish forming the piles 20 be depositing the blanks of the stream 24 on conveyor 25 and then to transfer each completed pile onto the belt 33 by shifting the piles from the table 26 in the direction of the arrow 30 by a pusher 31 to a position 29 on a conveyor 33, the braking mechanism 2, which acts on each stream 22, will be operated to prevent the stream 22 from further advancing. The result thereof is that the thickness of the stream 22 will termporily increase since during this interval of time, the printing and cutting machine 203, which is producing the box blanks, continues to operate at the same speed and thus the supply of additional box blanks being provided to the conveyor means 1 remains constant. As soon as the pusher 31 has transferred the piles 20 onto the conveyor 33 and in return to the initial position, and the movable table 26 has been hoisted to its upper level, the braking device 2 is released to allow the stream 22 to continue to move onto the conveyor 25 to form a new pile.

During the course of the braking phase, the piles located in the position 29 will be carried off by the belt conveyor 33 in the direction of arrow 32 towards the batch forming station 4. At the end of the conveyor 33, the position of the piles of blanks 29 will be changed by being rotated first in the plane of the base of each pile by 90° and then the rotated pile is then turned or is deposited on the conveyor 5 so that the blanks are standing on edge as illustrated by the pile 36.

The second movement is such that the previous top and bottom of the pile 29 becomes the side of the new piles 36 which are being transmitted in the batch forming mechanism 4. The piles represented by the batches of piles 36 will be aligned again by a pusher 37 which is arranged on the chain carrier and by lateral guides such as 38 and 39 which will hold the blanks in the desired position in order to move them to the selected batching stations such as 40 and 41, which are best illustrated in FIG. 13.

The conveying means or mechanism 1 as well as the braking means 2 are best illustrated in FIGS. 3–8. The stream of blanks in FIG. 3 is moved in a direction of arrow 42 by the conveying mechanism. On traveling out of the printer cutter such as 203, they will be taken over the conveyor such as 43, which will carry and deposit them on the conveyor 44 which in turn will transfer them to a conveyor such as 73. During the transfer of the stream of blanks from the conveyor 43 to the conveyor 44, they pass through the braking mechanism 2 which consists of a lower roll 45 which is supported in a cradle 46. The cradle 46 consists of two frames 47 best illustrated in FIG. 4 which extend parallel to each other and are interconnected by a cross bar such as 48. The cradle 46 is positioned in such a way that it may slide between two wall members or frame members 49 of the frame for the unit 201 containing the conveyor mechanism. The lower roll 45 is mounted by bearings such as 50 in the frame 47. At both of its ends, a lower roll 45 has a portion that extends through an elongated slot-like aperture 53 in the wall member 49 and has a friction wheel or caster 51 mounted thereon. The caster 51 will engage a linear cam 52 and create means for rotating the lower roll 45. Each of the frame portions 47 of the cradle 46 are provided on its lower part with a rack 54, which is engaged with a pinion 55 mounted on a shaft 56 which itself is mounted on the frame walls 49 by means of bearings such as 57. The shaft 56 is controlled in its rotation by a compressed air piston 58, which has one end 60 of its pull rod secured on a lever 59 which is attached to the shaft 56. To guide the movement of the cradle 49 as the piston 58 is actuated, each of the side walls 49 of the frame are provided with sliding shoes 61 engaging the upper surface of the frame member 47 of the cradle. To drive or rotate the roller 45, a chain pinion 62 is mounted on the roller 45 and is connected by a chain 81 to a pinion 80 (see FIG. 6) of a clutch 79 of the drive train. Thus, the roller 45 can be disconnected from a positive drive.

The braking mechanism 2 includes an upper roll or pressure roller 63, which operates jointly with the lower roll 45 and applies a braking effect on a stream of blanks. The upper pressure roller 63 is supported on a pair of lever arms 64, which lever arms are pivoted around an axis 65 by the actuation by a compressed air piston 66 whose rod is secured by a stud 67 to the lever 64. The conveyor 44, as best illustrated in FIG. 5 consists of a plurality of parallel extending belts 68 which are arranged one beside the other. These belts extend from a driven roller 69 which is supported by bearings 71 on a shaft 70 that extends between the two frame members 49. The sprocket wheel 72 is secured to the roller 69 to positively rotate the roller.

The conveyor 44 discharged onto the last conveyor 73 of the conveying means 1 when taken in the direction of transport 42. This last conveyor 73 consists of endless belts arranged one beside the other in the same manner as the belts 68 of the conveyor 44. The conveyor 73 has been designed in such a way that it may pivot around its drive shaft 74 so that the conveyor 73 may be pivoted from the conveying position which is illustrated in FIG. 3 by bold lines, to a reject position, which is illustrated in chain lines, by a compressed air piston 146 acting on side frame levers such as 147. When moved to the rejecting position the blanks being conveyed on the conveyor 44 are deposited on a reject removal belt 75. The deviation of a blank's travel to the reject belt 75 for depositing in a container such as 76 is when a deficiency in the print or the shape of the box blanks has been spotted by a checking device on the printer cutters such as 203. The flaw containing blanks are then ejected onto the reject belt 75 for conveyance to a recepticle 76.

Figure 6:
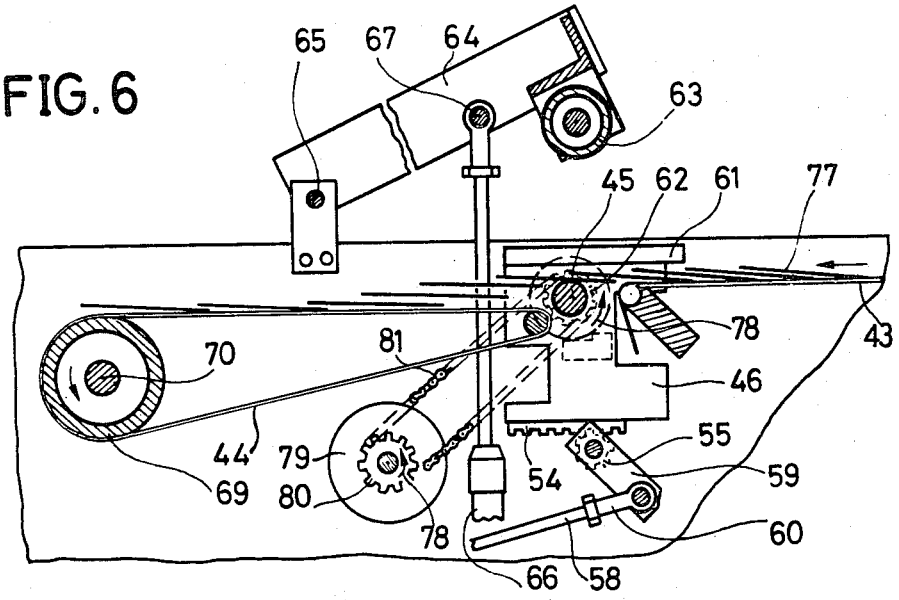
FIGS. 6, 7 and 8 schematically illustrate the braking mechanism in accordance with the present invention with FIG. 6 illustrating the braking mechanism being disengaged, FIG. 7 illustrating the initial engagement of the braking mechanism, and FIG. 8 illustrating the final portion of the engagement of the braking mechanism.
Figure 7:
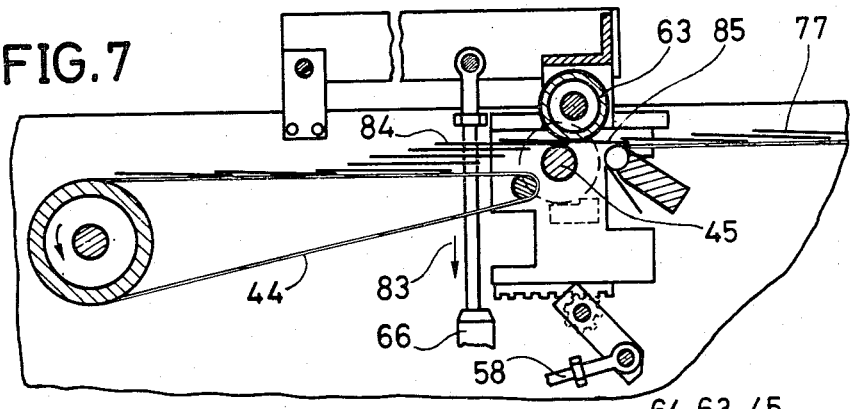
Figure 8:
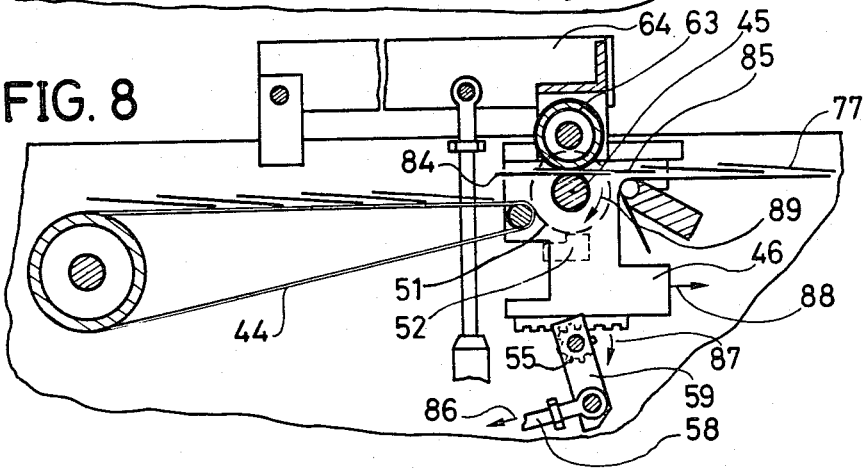

The action of the braking mechanism will be best explained and illustrated schematically in FIGS. 6, 7 and 8. In FIG. 6, a normally traveling stream of blanks is indicated at 77 and these streams such as 77 will be arranged one beside the other depending on the number of streams being conveyed in the conveyor means 1. At the position illustrated in FIG. 6, the lower roller 45 is being rotated continuously in the direction indicated by an arrow 78 through a drive mechanism including the clutch 79 which drives a pinion 80 which drives an upper chain 81 connected to the pinion 62.

Figure 9:
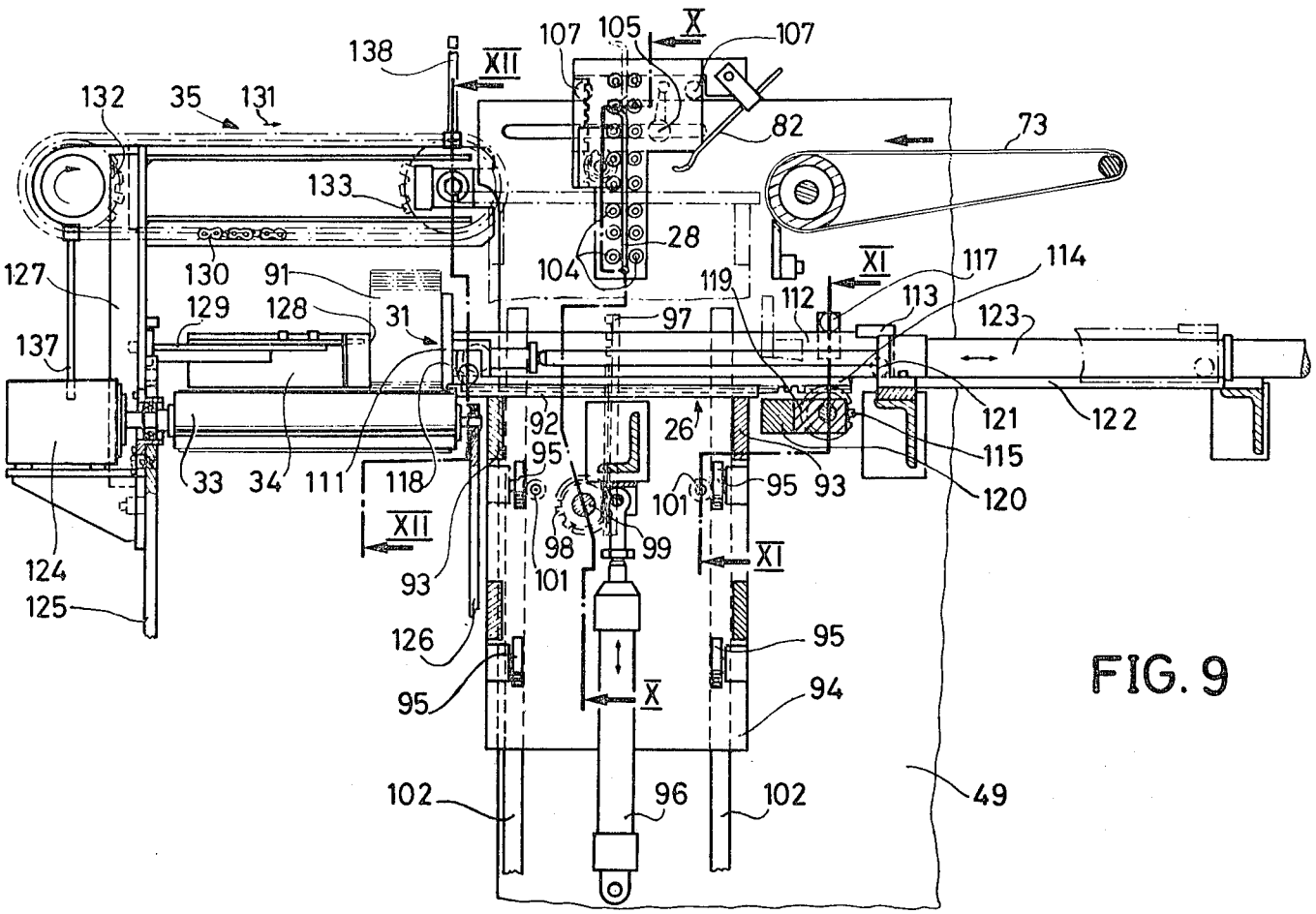
FIG. 9 is a partial cross-sectional view with portions in elevation for purposes of illustration of the piling mechanism and station as well as the removal station of the device of the present invention.

When a pile sensor 82 of FIG. 9 senses that the size of the piles have reached a given point, it sends a stop order for the blank stream which is received by a conventional control mechanism for operating the braking mechanism or means 2. At this point, the compressed air piston 66 is actuated in the direction of arrow 83 and the blanks 84 and 85 are nipped between the lower roll 45 and the upper pressure roller 63. Simultaneously, the clutch 79 is disengaged so that the lower roll ceases to be driven. Thus, those blanks which are on the conveyor 44 will continue toward the pile means while the blanks on the conveyor such as 43 will start to be backed up. As best illustrated in FIG. 8, the braking action exerted on the stream 77 includes insuring that the blanks such as 84 and 85 which are nipped between the roll 45 and the pressure roller 63 are prevented from dropping on the conveyor 44. This is accomplished by compressed air piston 58 being operated in the direction of arrow 86 (FIG. 8) to rotate the lever 59 and the pinions 55 in the direction of arrow 87. The action of the pinion 55 on the rack gear 54 will shift the cradle 46 in the direction of arrow 88. As the cradle 46 is shifted in the direction 88, the friction caster or roller 51 (FIG. 4) will be moved to a high curve of the linear cam 52 and rotate the lower roll 45 in a direction 89 which is opposite to the direction 78. Such a movement in the direction 89 causes the blank 84 to be shifted backwards to insure that it is held between the lower roll 45 and the pressure roller 63. The friction caster or roller and the linear cam act as second means for rotating the lower roll. It should be noted that as soon as the pile which is built up in station 3 has been fully removed, an order will be provided to the control to cause movement of the pressure roll 63 to the position illustrated in FIG. 6, the engagement of the clutch 79 and the movement of the cradle 46 in the direction opposite to the direction 88 to the position illustrated in FIG. 6 to disengage the second means for rotating the roll 45. At this point, the stream 77 will again be transferred to the conveyor 44 for continued transfer to the stacking or piling means.

As the flow of blanks is conveyed in the last conveyor 73 of the conveying means, they are discharged into the piling or stacking means and formed as a pile on a movable table 26. After being formed on the table 26, they are then pushed by a pusher 31 onto a pile removing conveyor 33. As illustrated in FIG. 9, a pile 91 of blanks is being pushed or moved by the pusher 31 onto the conveyor 33 and the table 26 is in the lower position.

Figure 11:
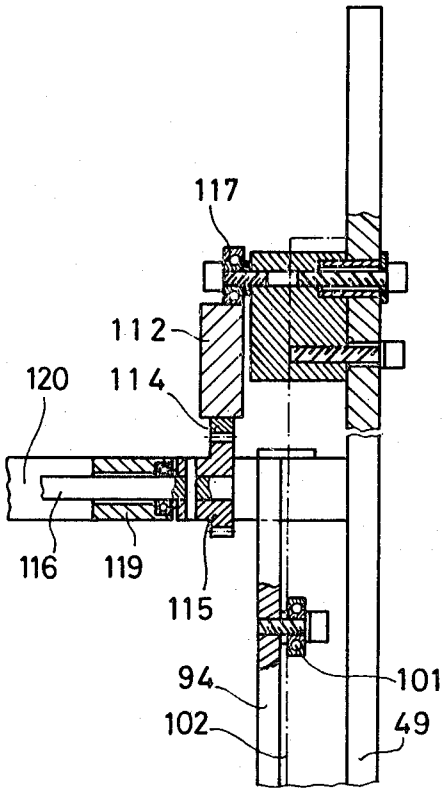
FIG. 11 is a partial cross-sectional view taken along the lines XI—XI of FIG. 9.
Figure 10:
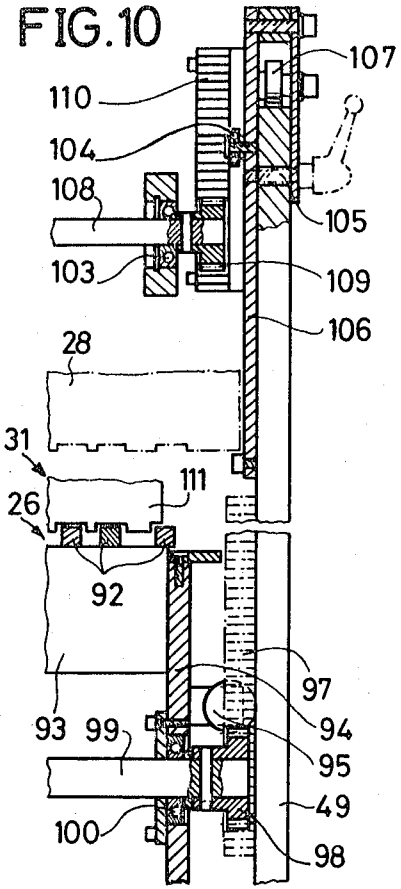
FIG. 10 is a partial cross-sectional view taken along the lines X—X of FIG. 9.

The table 26 consists of a plurality of bars or slats 92 which are spaced and fitted on a pair of cross bars 93 as illustrated in FIGS. 9 and 10. The cross bars 93 are connected at each end to a frame member 94 which is provided with guide rollers 95 that engage the interior of the wall 49 of the frame of the unit 201. Movement of the table 26 is accomplished by a compressed air cylinder 96. Both walls 49 are provided with racks 97 which are engaged by pinions such as 98 which are secured at both ends of an axle 98 which is mounted on the frame 94 by bearings 100. With this arrangement, a proper vertical shifting in parallelism of the movable table 26 is obtained. The guiding of the movable table 26 is also achieved by rollers such as 101 which run on rails 102 that are secured on the inner surface of both of the walls 49 as best illustrated in FIG. 11.

A front stop 28 is mounted by means which enables moving it in both a vertical direction and in the direction of transport for the blanks so that piles of blanks of different sizes can be obtained. To guide the movement of the stop 28 in the vertical direction, a plurality of rollers 104 which are mounted on a plate 106 engage the edges of the stop. The plate 106 is supported for movement in the direction of transport on the frame members 49 by a plurality of rollers 107 and can be locked in anyone of the specific positions by a device 105. The stop 108 has a pair of housings 103 which support an axle 108 who has pinions 109 at each end. The pinion 109 engage racks 110 which are secured on both of the walls 106. This insures proper parallel vertical shifting of the front stop 28. The stop 28 is provided on a lower part with notches (see FIG. 10) which receive the bars 92 and thus prevent the blank from passing between the stop 28 and the bars 92 during its initial placement on the table 26.

The pusher 31 also consists of the front plate 111 which has notches similar to the stop 28 for engagement or receiving the bars 92. The plate 111 is mounted on a frame which consists of two bars or members 112 which are interconnected by cross bars 113. Both of the bars 112 have on a lower part a rack 114 which engages a pinion 115. An axle 116 supports the pinions 115 at its end and every bar 112 is guided vertically by rollers 117, 118 and 121 (FIG. 11) while the roller 118 runs on one of the bars 92 of the movable table 26 and the roller or caster 121 runs on a guide 122 on the frame. The axle 116 is supported on a cross member 120 which extends between the two frame walls 49 by bearings 119. The pusher 31 is actuated by a compressed air piston 123 (FIG. 9).

Figure 12:
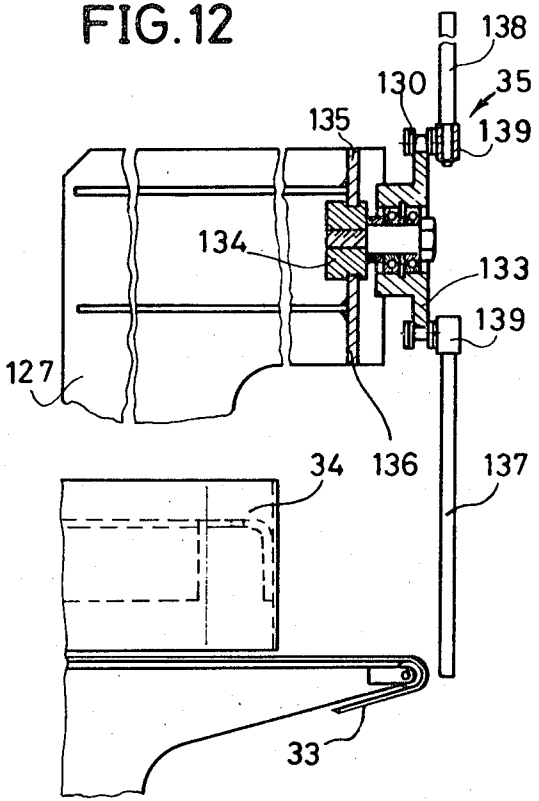
FIG. 12 is a partial cross-sectional view taken along the lines XII—XII of FIG. 9.

Conveyor 33 consists of an endless belt driven by a motor 124. The conveyor 33 is fitted between a frame member 125 and 126 and extends transverse or perpendicular to the direction of movement of the pusher 31. An aligning mechanism 35 is mounted on one end of the conveyor 33 by a support 127 which is screwed onto the frame walls or members such as 125. The support 127 also supports a movable stop 34 which consists of a nose 128, which is adjustably mounted on an arm 129. The aligning mechanism consists of an endless chain 130 which is supported on sprocket wheels 132 and 133. The chain 130 is driven in a direction 131 by the sprocket 132, which is mounted on the axle of a motor, which is not illustrated. The sprocket wheel 133 is best illustrated in FIG. 12 and is fitted on a hub 134 which can be moved on the rails 135 and 136 to enable tightening the chain 130 by locking the hub 133 in a position by conventional means which are not illustrated. The chain 130 is provided with two aligning fingers 137 and 138. These fingers 137 and 138 are mounted on a stud such as 139 which is secured on the axle of one of the links of the chain 130.

As best illustrated in FIG. 13, a pile 29 moving on the conveyor 33 will move past the movable stop 34. As it moves by the stop 34, the pile will be engaged by a finger such as 137 or 138 and rotated 90° with the length of the pile being parallel to the arrow 144. Thus, the pile is rotated in the plane of the sheets.

The unit 4 includes a chain 140 supported on two sprockets 141 and 142. The sprocket wheel 142 is secured on the axle of a reducing motor 143. The chain 140 will move in the direction of the arrow 144 and has pushers 37 which will engage the piles 36 which are deposited from the conveyor 33, align them and move them in the direction of movement 144. These pushers 37 move in the plane over the two lateral guides 38 and 39. As the pile is deposited by the conveyor 33 into the conveyor formed by the chain 140, an adjustable stop such as 145 guides the pile between two pushers 37, 37 and the pile is rotated by 90° so that the blanks in the piles 36 are standing on edge and the top and bottom blanks of each pile 29 becomes the two sides of the pile 36.

With the arrival of the pile between the pusher 37 and the guides 38 and 39, they are pushed along until they are opposite stations 40 and 41 which will receive the piles and from batches standing on ends. Both the stations 40 and 41 includes a sole plate 148 for receiving a batch or pile 149 which is moved by a pusher 150 thereon. During the transporting of the piles, it is inserted between two brushes 151 and 152, which are on the plate 148 and engage the edges of the pile such as 149. The pushers 150 consist of a channel 153 having a front part or plate 154 which is secured thereon by hinge 155. When the transporting of the pile 149 ends, the front part 154 is raised under the action of a compressed air cylinder 90 mounted on the channel 153. This operation allows the pusher to come back into its retracted position. When the pusher 150 is back in the retracted position, the front plate 154 is lowered again and a new pile is engaged by the channel 153. The channel 153 is mounted on the ends of a compressed air piston 156 which is mounted on the frame 6. The compressed air piston of each of the stations 40 and 41 are driven as follows. At the arrival of the first pile at the station 41 and the following pile for the station 40, the pistons are actuated to move both pushers to push each of the piles into their respective stations. Then the compressed air pistons are actuated to withdraw each of the pushers and their respective channels 153 to the retracted position. The new piles are then brought into the position for each of the stations 40 and 41. At this time, the pushers again are actuated to push the piles between the brushes 151 and 152 of each of the stations. The pushers are retracted and after retracting of the pushers, the operator can then remove the two batches of blanks at each of the stations so that new batches can be formed.

Although various minor modifications may be suggested by those versed in the art, it should be understood that I wish to embody within the scope of the patent granted hereon, all such modifications as reasonably and properly come within the scope of my contribution to the art.

I claim:

1. A device for creating batches of flat workpieces especially box blanks comprising conveyor means for transporting the box blanks in at least one stream of staggered blanks in a transport direction, said conveyor means enabling adequate staggering of the box blanks in each stream; means for braking and separating the blanks in each stream of box blanks; means for removing box blanks having contingent flaws from the conveyor means; piling means for forming piles of box blanks from the stream of blanks in the conveyor means; removing means for removing the piles of box blanks created in said piling means; means for creating batches of box blanks from said piles; and means for transferring said piles of box blanks in an aligned fashion to said means for creating batches; said conveyor means including several conveyors assembled one after another in the transport direction in a frame; said means for removing box blanks with contingent flaws including the last conveyor of said conveyor means in the transport direction being constructed to be pivoted around a drive roller from a conveyor position to a reject position and a reject receiving belt extending cross-wise to the transport direction being arranged adjacent said last conveyor to receive blanks as the conveyor is pivoted to the reject position; the means for braking and separating comprises a lower roll arranged between a pair of conveyors in said conveyor means, said lower roll being carried on a cradle mounted in said frame for movement along said transport direction, an upper pressure roller, means for moving the upper pressure roller from a position above said lower roll to a position pressing a blank therebetween, means for rotating the lower roll in one direction including a clutch, second means for rotating the lower roll in a direction opposite to the one direction of rotation, said second means being actuated by movement of said cradle in said frame in a direction opposite to the transport direction; said piling means including a front stop being mounted for adjustment in both a vertical direction and the transport direction, and means for determining the height of the blanks in the piling means; said means for removing the piles of blanks including a removable belt and a pusher for pushing said piles from said piling means onto the removal belt, said pusher means being actuated in response to the means for determining a predetermined height of said piles, said means for transferring the piles from the means for removing the piles to the means creating batches, aligning each of said piles and including means for rotating the piles through at least 90° in the plane of the blank and means for rotating the pile to stand on the edges of the blank, and said means for creating batches including a conveyor chain for moving the piles while standing on edge and joggers for shifting the piles into a delivery stations as batches of box blanks standing on edge.

2. A device according to claim 1, wherein the means for moving the upper pressure roller includes a pair of arms mounting the upper pressure roller for free rotation, said pair of arms being mounted in the frame of the conveyor means for pivotable movement from the position with the pressure roller pressing the blank between the lower roll and the upper pressure roll and a second position disengaged from the blanks crossing the lower roll.

3. A device according to claim 1, wherein the second means for rotating the lower roll includes a linear cam, a friction roller mounted on the shaft of the lower roll engaging said linear cam as the cradle is shifted in a direction opposite to the transport direction.

4. A device according to claim 1, wherein said piling means includes a platform being mounted in the frame of the device for movement in a vertical direction and means for moving the platform in said vertical direction so that as the height of the pile increases, the platform is lowered in said frame.

5. A device according to claim 1, wherein the removal belt for the means for removing the piles extends in a direction transverse to the direction of movement for said pusher.

6. A device according to claim 1, wherein the means for rotating the pile through 90° in the plane of the blanks includes an endless chain having catches being positioned adjacent the end of said removal belt and retractable stop arranged adjacent the end of the removal belt cooperating with said catches to cause said rotation.

7. A device according to claim 6, wherein said removal belt extends in a direction transverse to the direction of movement of said pushers.

8. A device according to claim 7, wherein the means for rotating the pile to stand on its edge comprises the end of the removal belt of the means for removing piles being positioned above the conveyor chains for the means for creating batches so that as a pile is transferred from said belt to said conveyor chains it is rotated onto the edge of the blanks.

9. A device according to claim 1, wherein each of said delivery stations includes brushes engaging edges of the piles as the piles are shifted therein.

* * * * *